US011602783B2

(12) United States Patent
Busch et al.

(10) Patent No.: US 11,602,783 B2
(45) Date of Patent: Mar. 14, 2023

(54) APPARATUS AND METHOD FOR PRODUCING A CAST PART FORMED FROM AMORPHOUS OR PARTIALLY AMORPHOUS METAL, AND CAST PART

(71) Applicant: Amorphous Metal Solutions GmbH, Homburg (DE)

(72) Inventors: Ralf Busch, Saarbrucken (DE); Benedikt Bochtler, Nalbach (DE); Oliver Gross, Rehlingen-Siersburg (DE); Simon Hechler, Saarbrucken (DE); Alexander Kuball, Saarbrucken (DE)

(73) Assignee: AMORPHOUS METAL SOLUTIONS GMBH, Homburg (DE)

( * ) Notice: Subject to any disclaimer, the term of this patent is extended or adjusted under 35 U.S.C. 154(b) by 0 days.

(21) Appl. No.: 17/253,258

(22) PCT Filed: Jun. 25, 2019

(86) PCT No.: PCT/EP2019/066761
§ 371 (c)(1),
(2) Date: Dec. 17, 2020

(87) PCT Pub. No.: WO2020/002291
PCT Pub. Date: Jan. 2, 2020

(65) Prior Publication Data

US 2021/0276079 A1 Sep. 9, 2021

(30) Foreign Application Priority Data

Jun. 29, 2018 (DE) ..... 10 2018 115 815.7

(51) Int. Cl.
*B22D 17/12* (2006.01)
*B22D 17/28* (2006.01)
*B22D 21/00* (2006.01)

(52) U.S. Cl.
CPC ..... *B22D 17/12* (2013.01); *B22D 17/28* (2013.01); *B22D 21/00* (2013.01)

(58) Field of Classification Search
CPC ..... B22D 17/12; B22D 17/2038; B22D 17/28
See application file for complete search history.

(56) References Cited

U.S. PATENT DOCUMENTS 2,839,800 A * 6/1958 Hodler ..... B22D 17/32 164/314
4,842,038 A * 6/1989 Fujino ..... B22D 17/02 164/113

(Continued)

FOREIGN PATENT DOCUMENTS

DE 4116071 A1 11/1991
DE 69823966 T2 5/2005

(Continued)

*Primary Examiner* — Kevin E Yoon
*Assistant Examiner* — Jacky Yuen
(74) *Attorney, Agent, or Firm* — Michael J. Feigin, Esq.; Feigin and Fridman LLC

(57) ABSTRACT

The invention relates to an apparatus (1; 1*a;* 1*b;* 1*c;* 1*d;* 1*e*) for producing a casting (36) formed from an amorphous or partially amorphous metal, which comprises a casting mold (3; 3*a;* 3*b;* 3*c;* 3*d;* 3*e*) having at least one filling opening (16; 16*a;* 16*b,* 41; 16*c;* 16*d;* 16*e*) for introducing a casting material (15; 15*a;* 15*b;* 15*c;* 15*d;* 15*e*) forming the casting (36) and a device for melting the casting material (15; 15*a;* 15*b;* 15*c;* 15*d;* 15*e*). The melting device expediently has at least one region (13; 13; 13*b;* 40, 13*c;* 13*d;* 13*e*) which is provided for melting the casting material (15; 15*a;* 15*b;* 15*c;* 15*d;* 15*e*). Advantageously, an apparatus is created that allows a particularly targeted application of melting energy into the casting material. In an embodiment, the melting device comprises a means for forming at least one electric arc (30; 30*a,* 39) in the at least one melting region (13; 13; 13*b;* 40, 13*c;* 13*d;* 13*e*), which in particular comprises at (Continued)

Figure 1A:
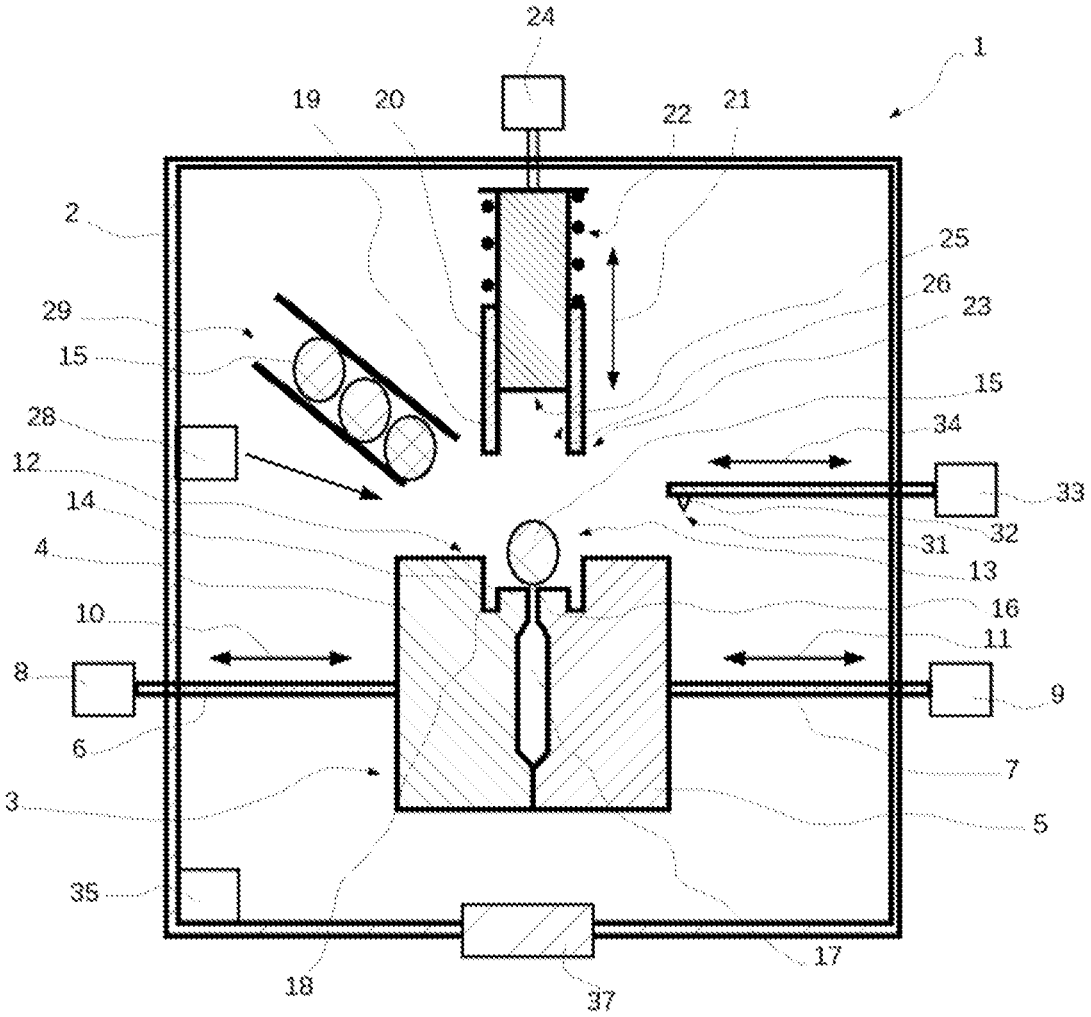

least two electrodes (32; 32*a,* 38; 32*b;* 32*c*) arranged at a distance from one another, between which the at least one electric arc (30; 30*a,* 39) can be formed.

9 Claims, 9 Drawing Sheets

(56) References Cited

U.S. PATENT DOCUMENTS

| | | | | | |
|---|---|---|---|---|---|
| 4,919,191 | A | * | 4/1990 | Brodersen | B22D 18/04 164/133 |
| 5,740,854 | A | * | 4/1998 | Inoue | B22D 11/009 164/122 |
| 5,860,468 | A | * | 1/1999 | Cook | B22D 17/14 164/113 |
| 6,044,893 | A | * | 4/2000 | Taniguchi | B22D 17/28 164/63 |
| 2007/0215306 | A1 | | 9/2007 | Muramatsu et al. | |
| 2015/0096967 | A1 | | 4/2015 | Lee et al. | |
| 2016/0271689 | A1 | | 9/2016 | Fu et al. | |

FOREIGN PATENT DOCUMENTS

| | | | | |
|---|---|---|---|---|
| DE | 102010027802 | A1 | | 5/2012 |
| DE | 102015220766 | A1 | | 4/2016 |
| JP | 2000254765 | A | | 9/2000 |
| JP | 2000-326065 | A | | 11/2000 |
| JP | 2010227961 | A | * | 10/2010 |
| JP | 2010227961 | A | | 10/2010 |
| JP | 2014039936 | A | | 3/2014 |

* cited by examiner

APPARATUS AND METHOD FOR PRODUCING A CAST PART FORMED FROM AMORPHOUS OR PARTIALLY AMORPHOUS METAL, AND CAST PART

The invention relates to an apparatus for producing a casting formed from an amorphous or partially amorphous metal, which comprises a casting mold with at least one filling opening for introducing a casting material forming the casting and a device for melting a casting material. Furthermore, the invention relates to a method for producing the casting and a casting made of an amorphous or partially amorphous metal.

Amorphous metals are metallic materials that do not solidify in crystalline form. They are also known as metallic glasses and have excellent mechanical properties due to their amorphous or partially amorphous structure.

Devices and processes for the production of castings from amorphous metals are known from the state of the art. A casting material is inductively heated in a crucible and is pressed into a permanent mold by means of a casting plunger through a filling opening in a die-casting process.

Disadvantageously, the use of a crucible can add impurities to the melt which can cause crystallization during solidification. Advantageous mechanical properties are thereby lost. Furthermore, only a slight superheating of about 50 to 60° C. above the melting temperature of the casting material can be achieved by inductive heating of the casting material in the so-called cold crucible process. In order to ensure amorphous solidification, the cast material must preferably be heated to a temperature that is far above its melting temperature, in particular between 75 and 1300° C. above.

An object of the present invention is to create an apparatus for the production of a casting formed from an amorphous or partially amorphous metal, which enables a particularly high superheating of the casting material as well as easy processability.

According to the invention, the object is achieved in that the melting device has at least one region which is provided for melting the casting material.

In the melting region of the melting device, the cast material can be melted and superheated up to 1300° C. The required energy can be applied very specifically into the casting material, which can be in pellet-shape, for example. Adjacent regions or neighboring components of the device are advantageously not thermally stressed. Furthermore, the casting material needs only to be melted immediately before it is pressed into the mold. Conveying from a furnace, whereby the temperature of the melt can drop sharply, is not necessary. The high superheating possible with the device according to the invention also ensures that a casting can solidify amorphous or partially amorphous, in particular predominantly amorphous.

It is expedient for the melting device to have a means for forming at least one electric arc in the at least one melting region, which means comprises in particular at least two electrodes arranged at a distance from each other, between which the at least one electric arc can be formed. The electric arc can extend from one electrode to a preferably pellet-shaped cast material to be melted and/or can be guided over the surface of the cast material. It is advantageous to apply the energy required for melting into the pellet in a targeted manner so that surrounding regions are not thermally stressed. If several melting regions are provided in which a casting material is to be melted, several electrodes can be provided, from each of which at least one electric arc extends towards the casting material to be melted. It is also conceivable that several electric arcs are formed to melt a single, preferably pellet-shaped cast material. A particularly high superheating and a faster melting of the casting material is possible.

It is also conceivable that the cast material is melted by a laser and/or an electron beam.

In an embodiment of the invention, one of the at least two electrodes is at least partially formed by the casting material. It is advantageous that the casting material does not have to be contacted electrically separately. This makes the manufacturing process easier to handle.

In a further embodiment of the invention, the at least one melting region is integrated into the casting mold. For this purpose, the melting region is preferably fluidically connected to a filling opening of the casting mold. Due to the fact that preferably an electric arc, a laser beam and/or an electron beam is/are used to melt the casting material, an energy input is locally limited to the casting material. A thermal damage of the casting mold is excluded. It is advantageous that the casting material can be melted and afterwards immediately introduced into the mold through the filling opening. A transport route from a distant melting region to the casting mold is not necessary.

If several melting regions are provided, several castings can be produced simultaneously with a single casting mold, for example.

It is also conceivable that several melting regions are provided to fill a single mold cavity through several filling openings. It is advantageous to produce larger castings.

It is expedient that the at least one melting region comprises an in particular trough-like recess and/or a socket-like ridge for receiving the casting material, and is preferably arranged at least partially around the at least one filling opening. The casting material can be placed on the socket-like ridge or be placed in the recess and can be melted. It is also conceivable that a recess is provided which has a receiving socket-like ridge.

Because the filling opening is or are fluidically connected to the ridge and/or the recess, the melted casting material can be introduced directly through it into a mold cavity of the casting mold.

The cast material can be placed, for example, as a pellet on the filling opening so that the opening is covered. Due to the high viscosity and/or the high surface tension of a melted metal alloy that solidifies amorphously or partially amorphously, the pellet retains its shape in the melted state and covers the filling opening until it is pressed into the mold by means of a casting plunger.

In an embodiment of the invention, the at least one melting region is delimited by an end face of an in particular cylindrical casting plunger, which is provided for pressing melted casting material into a mold cavity of the casting mold, and an inner wall of a guiding means in which the casting plunger is mounted in a guided manner, the guiding means preferably comprising a cylindrical sleeve. The inner wall and an end face of the plunger form a crucible in which the casting material can be melted immediately before it is pressed into the casting mold. It is advantageous to fill a casting mold against gravity ("from below"). If a movement of the casting plunger is controlled, a mold filling speed or a speed profile can be defined. For this purpose, a control device may be provided, which is especially designed for simultaneous movement of the casting plunger and the sleeve into the direction of a filling opening of the casting mold.

Since the melted casting material only remains in the crucible for a very short time before it is pressed into the casting mold, any contamination is advantageously excluded.

In a further embodiment of the invention, at least one in particular cylindrical casting plunger, which is provided for pressing melted casting material into a mold cavity of the casting mold, is movable relative to a guiding means in which the casting plunger is mounted in a guided manner, in particular against a direction of action of a restoring force of a restoring means. The restoring means may include a spring, for example. Wall sections of the guiding means, which is designed as a sleeve, for example, protrude over a base surface of the casting plunger with which the latter is in contact with a melted casting material. This allows a space to be formed when the sleeve is docked to the casting mold, said space is delimited by inner walls of the sleeve, the end face of the casting plunger and a casting mold section containing the filling opening. As the casting plunger moves relative to the guiding means, the space is reduced and the melted casting material in the space is pressed into the mold. Once the casting material is pressed in, the plunger and sleeve are moved simultaneously to an initial position away from the casting mold. During this process, the restoring force causes the casting plunger to move back to its initial position, in which the space has a maximum volume and a new casting process can be carried out.

In an embodiment of the invention, the at least one melting region is provided for receiving the guiding means and has in particular a preferably annular groove. The annular groove is in particular incorporated into the casting mold. In this way, the guiding means can be tightly connected to a casting mold section having the filling opening in order to form a space which receives the casting material before it is pressed into the casting mold. As a result, the casting material is solely pressed into the casting mold.

It is expedient that a temperature of the casting mold is changeable. Preferably the temperature is adjustable by a control device. The casting mold can be air, water and/or oil cooled. Furthermore, the temperature of the casting mold can be kept constant by continuous process control. This improves the process stability.

In a further embodiment of the invention, the device comprises a device for venting and/or sucking melted casting material into the casting mold, said means for venting being preferably activatable upon introduction of the casting material into the casting mold. This allows a suction force to be applied in addition to the pressure force of an casting plunger, said suction force sucking the melted casting material into the casting mold. This is particularly advantageous when casting melted, highly viscous alloys. In addition, venting, i.e. extracting gas from the mold, which can be a flushing gas such as argon, prevents formation of gas inclusions in the casting. Advantageously, a very good casting quality is possible.

It is conceivable for the casting mold to consist of at least two parts and preferably of a particularly heat-conducting material, preferably copper or a copper alloy. A high cooling rate is required to prevent undesired crystallization of an amorphous or partially amorphous solidifying metal alloy. Casting molds made of copper or copper alloys are particularly suitable. If the casting mold has at least a two-part design, the mold can be opened and closed and can be used several times, especially as a permanent mold.

In a further embodiment of the invention, the device has an especially gas-tight housing into which at least the casting mold and the at least one melting region are implemented. It is advantageous that the housing can be evacuated and/or filled with a protective gas, for example argon or another noble gas, so that no oxygen is present inside the housing. This means that oxidation of the casting material is not possible either during melting or when the material is pressed into the casting mold. Advantageously, the production of high-quality castings is possible.

In an embodiment of the invention, a feeding device is provided which is designed to feed solid casting material into the at least one melting region. The feeding device can be a pellet magazine, for example, which introduces a new pellet into the melting region after each casting process. Advantageously, the production process according to the invention can be automated.

A means of determining a temperature of the casting material, of the melted casting material and/or of the casting mold is conveniently provided, preferably a pyrometer. It is advantageous to be able to monitor a temperature at any time, especially an superheating temperature which is between 75 and 1300° C. above the melting temperature of the casting material, preferably up to 800° C.

Embodiments of the invention are to be explained in more detail below on the basis of examples with reference to the non-limiting figures.

Figure 1B:
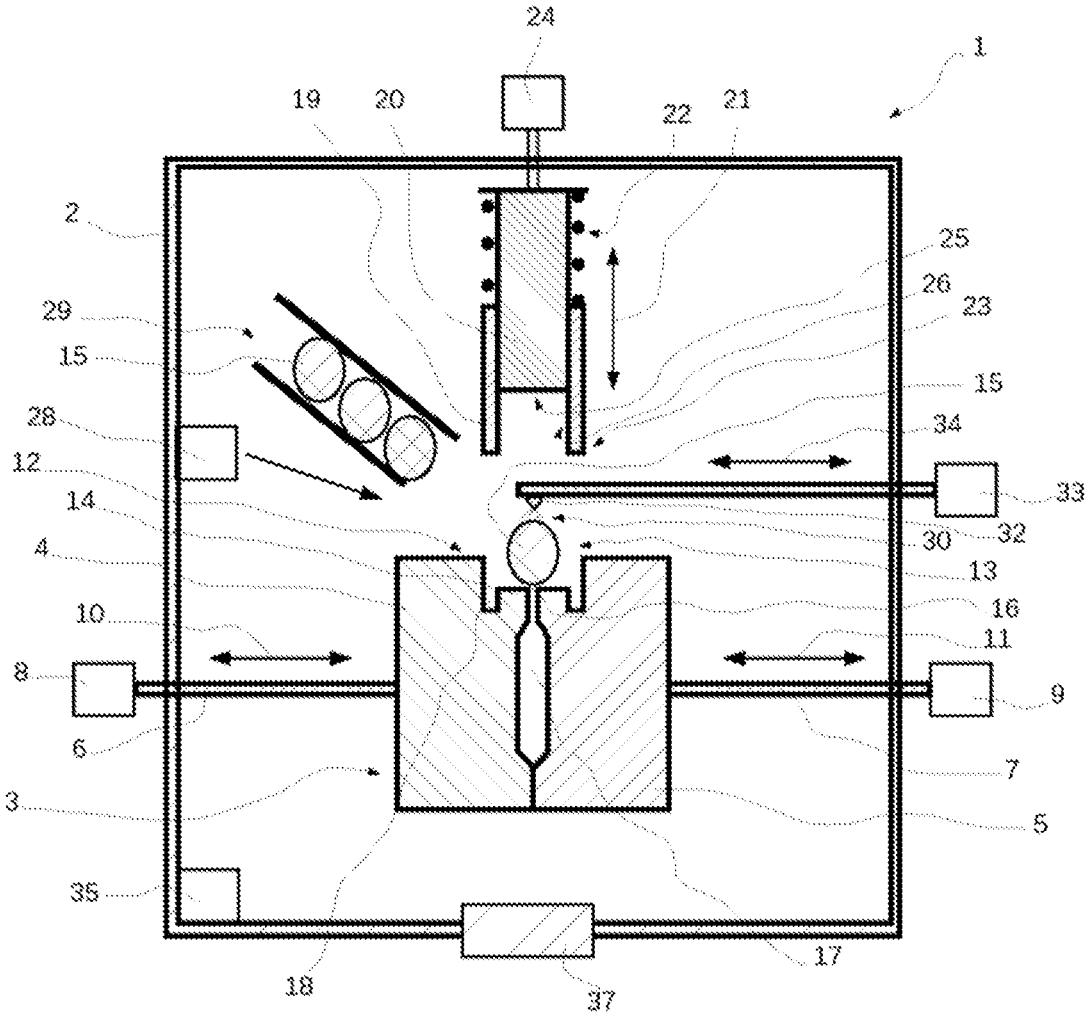
Figure 1C:
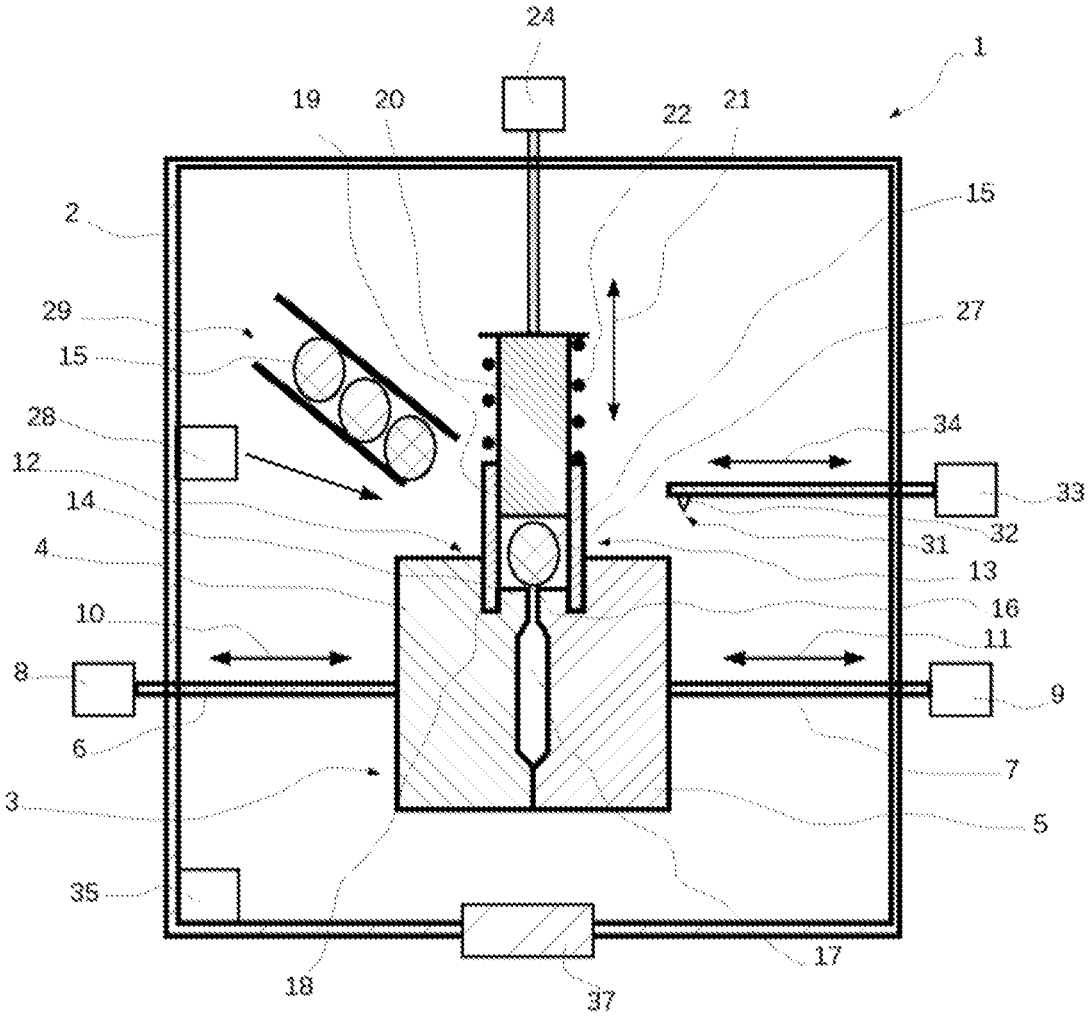
Figure 1D:
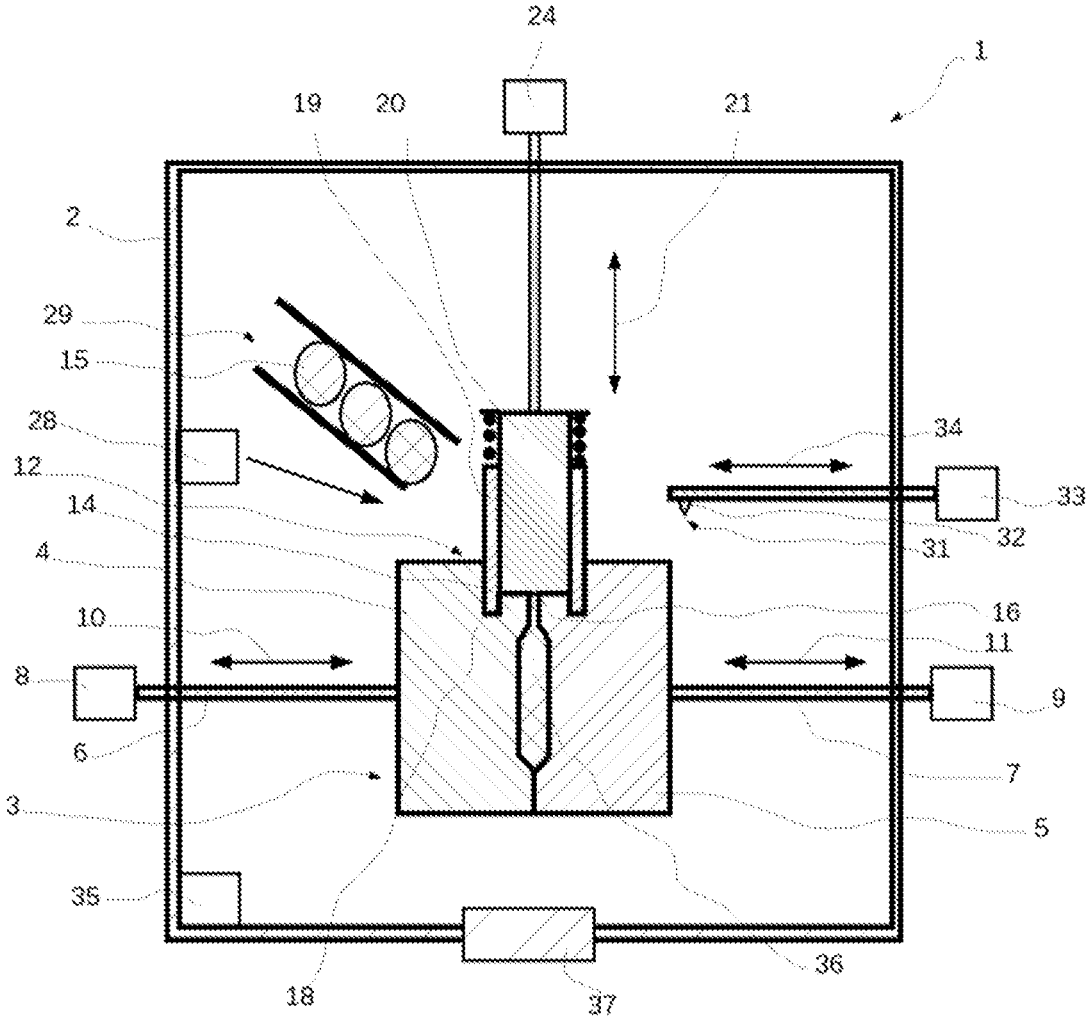
Figure 1E:
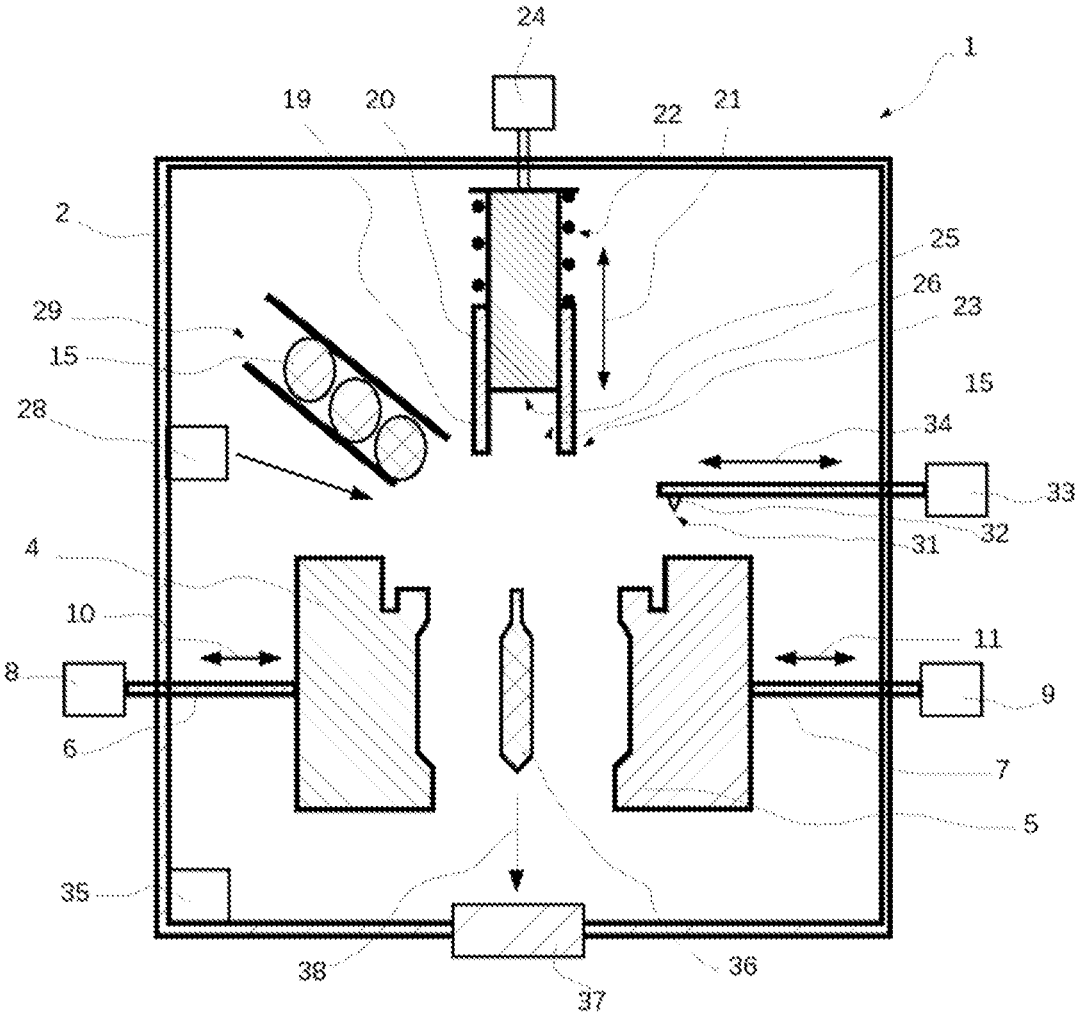
Figure 2:
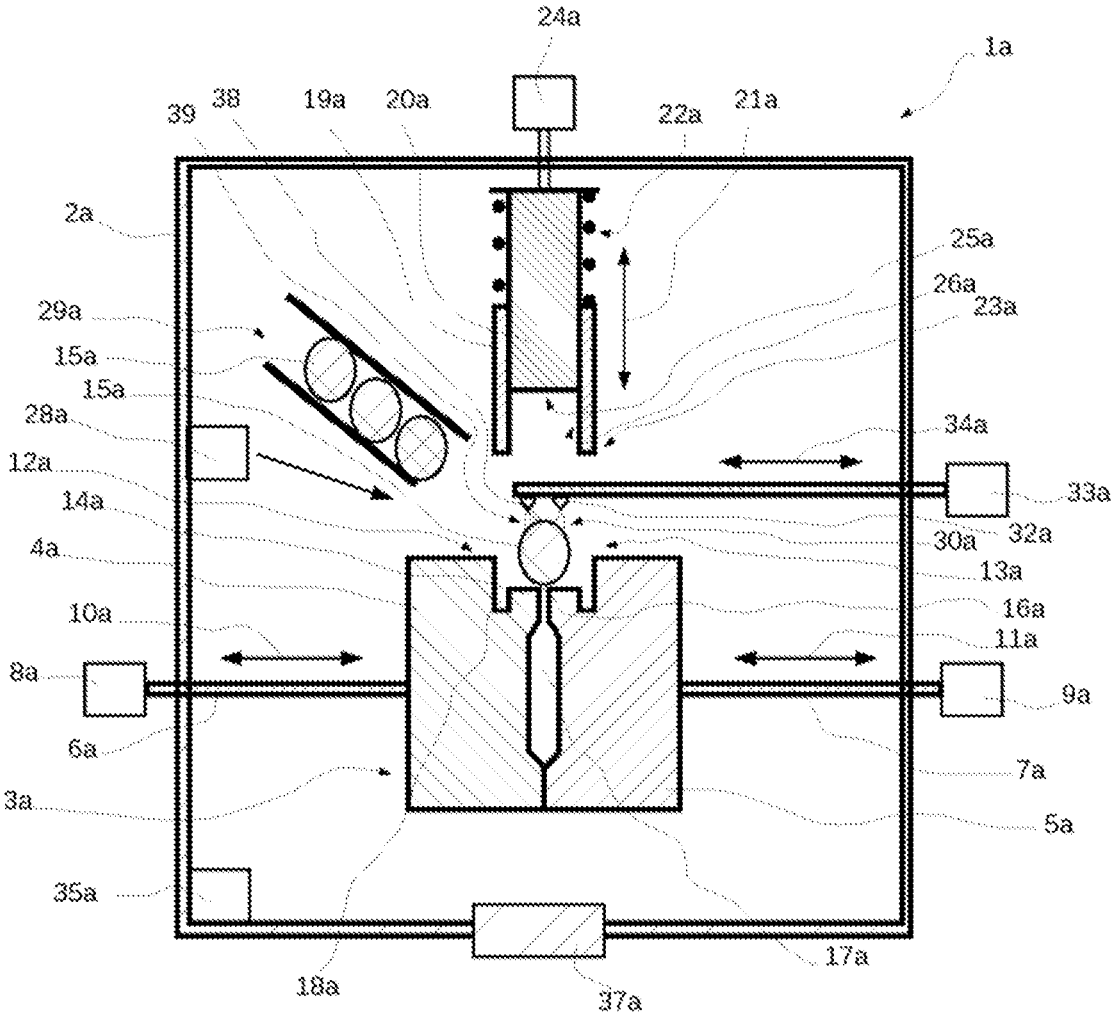
Figure 3:
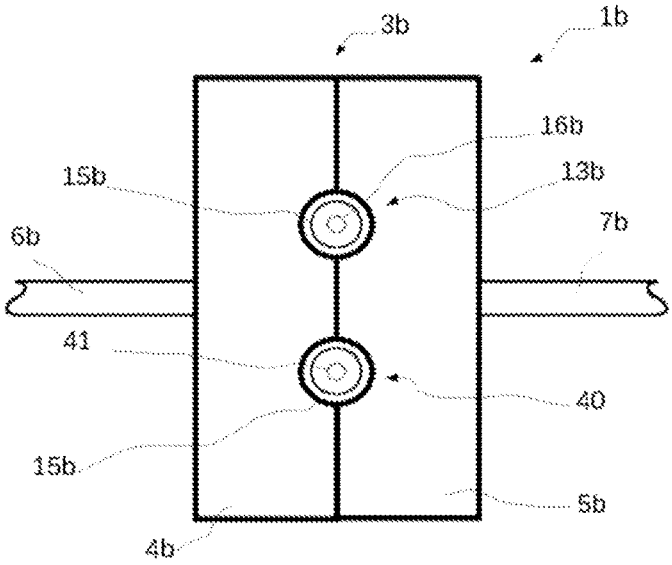
Figure 4:
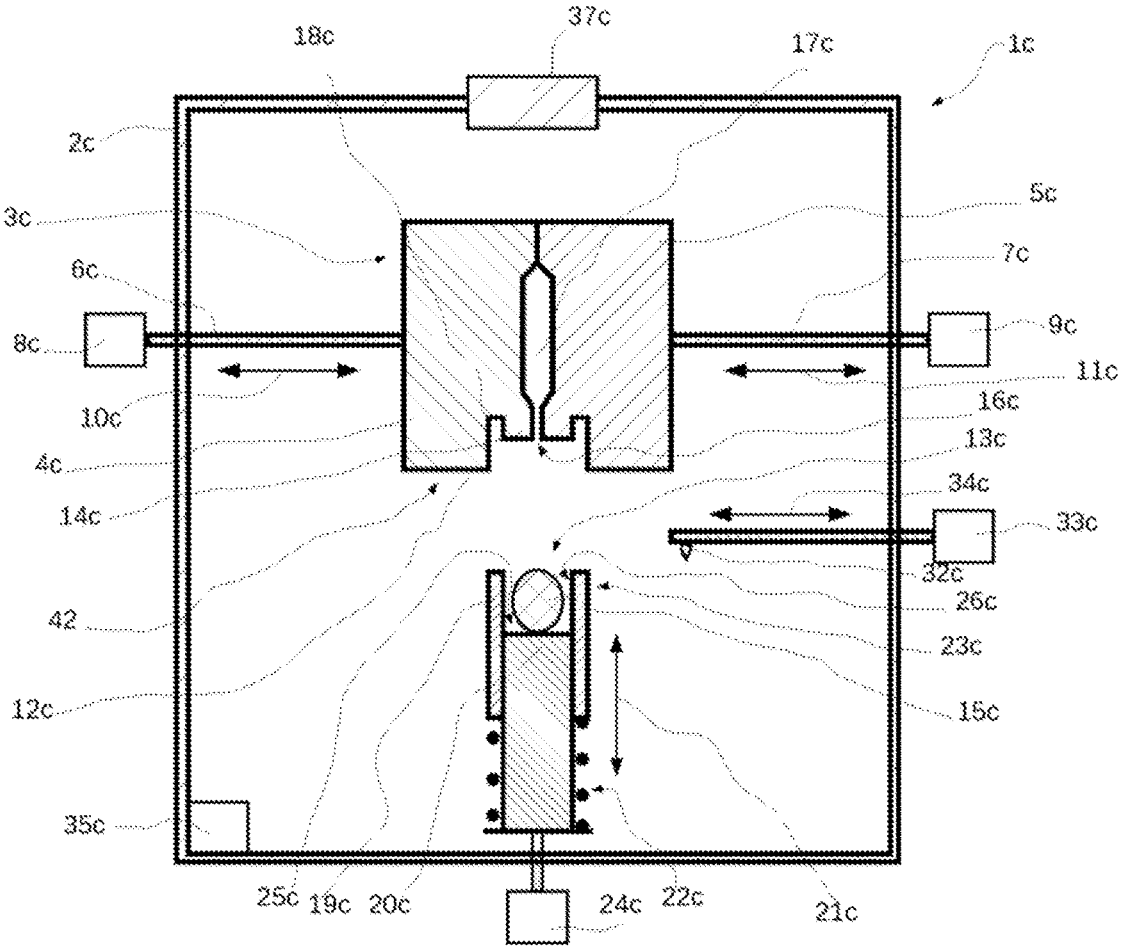
Figure 5:
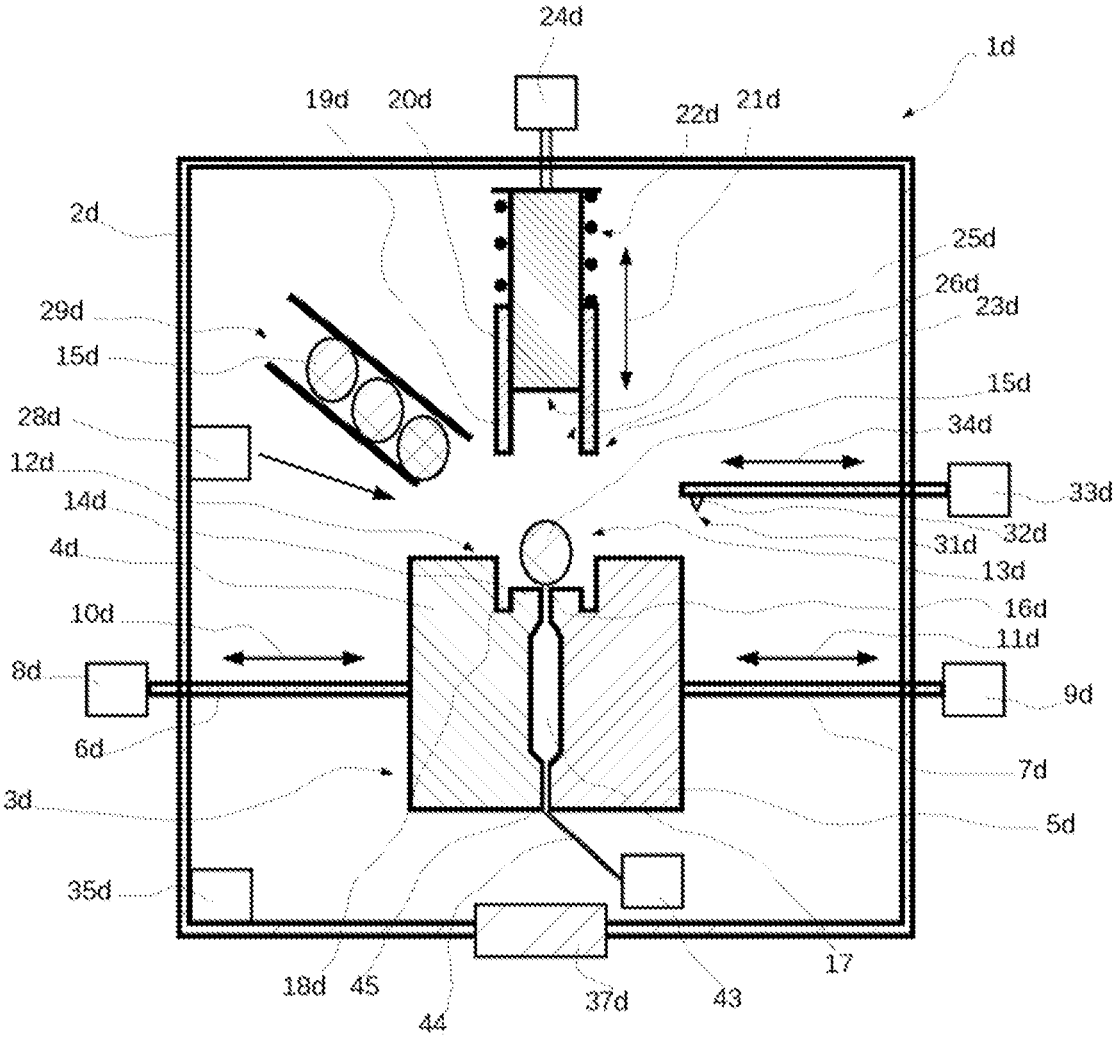
Figure 6A:
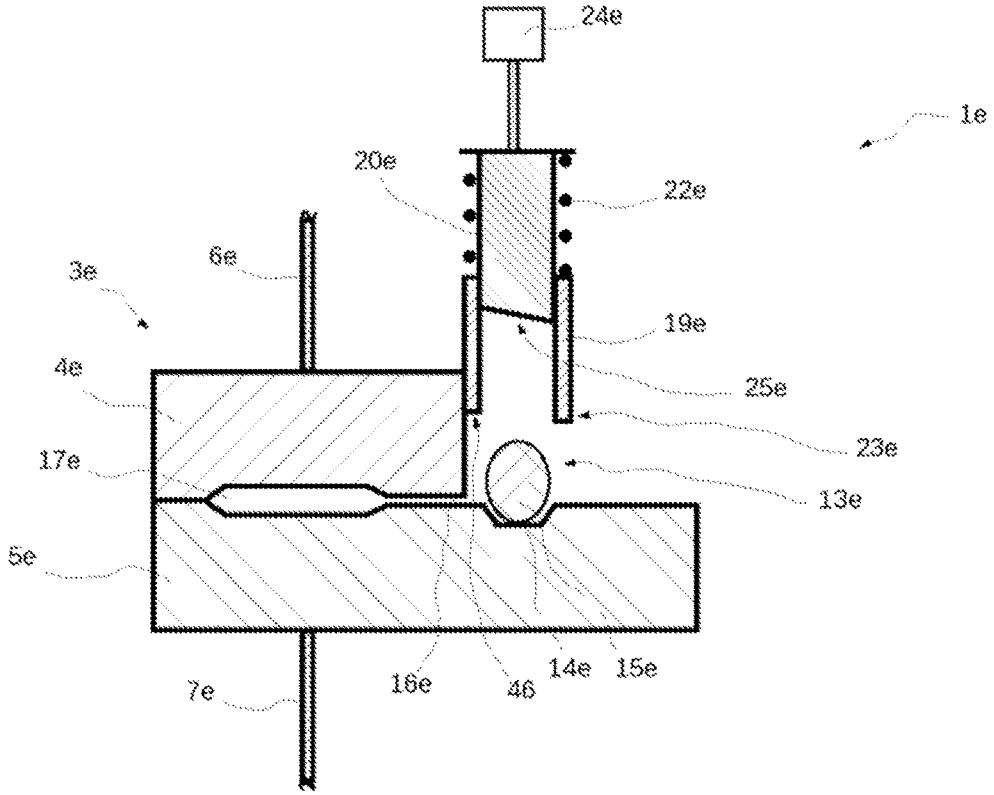
Figure 6B:
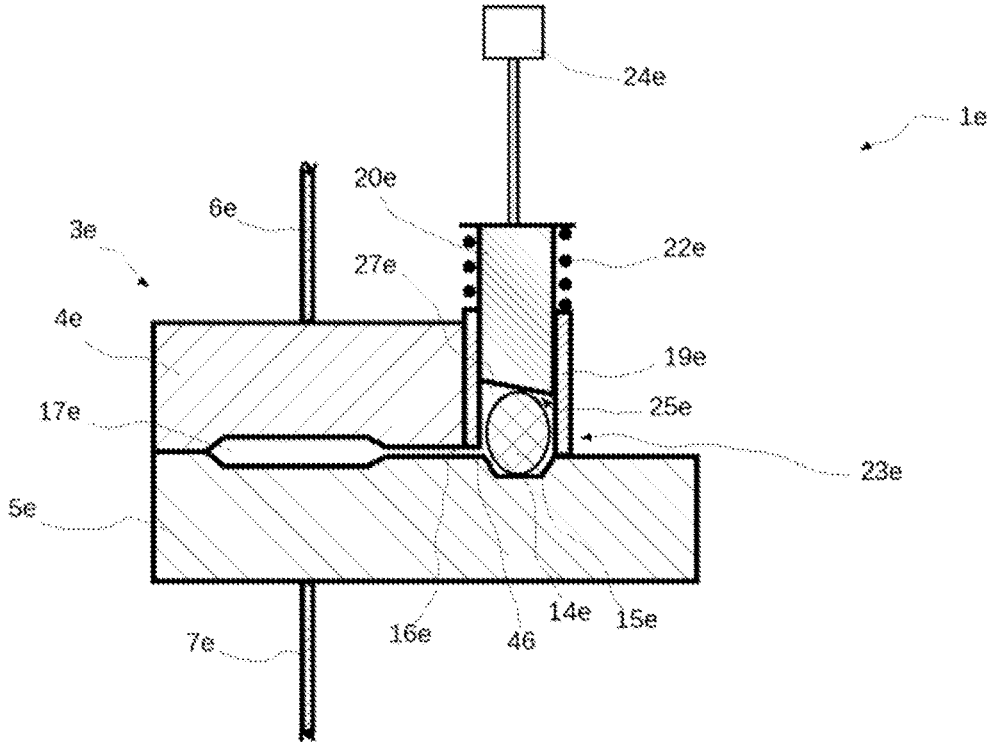

FIG. 1*a-e* schematic representation of an apparatus according to the invention, FIG. 2 a schematic representation of another embodiment of an apparatus according to the invention, FIG. 3 a detail of an apparatus according to the invention, FIG. 4 a schematic representation of a further embodiment of an apparatus according to the invention, FIG. 5 a schematic representation of a special embodiment of an apparatus according to the invention, FIG. 6 Details of another special embodiment of an apparatus according to the invention.

An apparatus (1) shown schematically in FIG. 1*a-e* in cross-section comprises a housing (2) into which a two-part, water-cooled copper casting mold (3) is implemented. Each of the two parts (4,5) of the casting mold (3) is connected by means of a rod (6,7) to a motor (8,9) mounted outside the housing for moving the rods (6,7). By moving the rods (6, 7), the casting mold (3) can be opened for removal of a casting in the direction of the double arrows (10, 11) and closed for the production of a further casting.

On an upper side (12) of the casting mold (3) a melting region (13) is incorporated, which has a socket-like ridge (14) formed by both parts (4, 5) of the casting mold (3) and on which a pellet (15) of casting material is placed. A filling opening (16) through which a mold cavity (17) can be filled with the casting material is completely covered by the pellet (15). An annular groove (18) is arranged around the base (14), which is provided for receiving a cylindrical sleeve (19). The sleeve (19) is designed to guide a cylindrical casting plunger (20) and surrounds it. The casting plunger (20) and the sleeve (19) are simultaneously movable by a motor (24) in the direction of the double arrow (21) and the casting plunger (20) is arranged displaceably relative to the sleeve (19) in the axial direction thereof with or against a restoring force of a spring (22). To press a melted casting material (15), which can be superheated up to 1300° C., preferably up to 800° C., into the mold, the casting plunger (20) and the sleeve (19) are moved simultaneously in the direction of the casting mold (3) until a lower section (23) of the sleeve (19) engages with the annular groove (18). A further movement of the casting plunger (20) in the direction of the casting mold (3) takes place against a restoring force of the spring (22). A space (27) formed by an end face (25)

of the casting plunger (20) and an inner wall (26) of the sleeve and the top (12) of the casting mold (3), as shown in FIG. 1*c*, is thereby reduced so that the melted casting material (15) is pressed vertically into the mold cavity (17).

Furthermore, the device comprises a pyrometer (28), which detects a temperature of the pellet (15) during melting, and a feeding device (29) which is designed as a pellet magazine. Thus, a new pellet (15) can automatically be placed on the ridge (14) of the melting region (13) after each casting production.

The cast material pellet (15) is heated by an electric arc (30) as shown in FIG. 1*b*, which is formed between a tungsten electrode (32) provided with a tip (31) and the pellet (15). For this purpose, the housing (2) as well as the casting mold (3) and the pellet (15) are electrically conductively connected to each other and form a counter-electrode to the tungsten electrode (32). The tungsten electrode (32) is movably arranged in the housing (2) and can be moved by a motor (33) in the direction of the double arrow (34) towards the melting region (13) and after melting away from the melting region (13).

It is also conceivable that a device not shown in FIG. 1 is provided for forming a laser beam and/or an electron beam, which is set up to heat the casting material pellet (15) in the melting region (13).

In addition, a not shown vacuum pump is provided to evacuate the housing (2) and a not shown means of introducing a protective gas such as argon. In addition, inside the housing (2) there is a so-called getter (35), which is designed as a titanium plate and which is heated before the casting material (15) is melted. Due to the very high affinity of titanium to oxygen and the very high solubility of oxygen in titanium, oxygen residues are removed from the housing atmosphere provided with the protective gas. This causes an additional cleaning of the atmosphere.

A casting (36) can be removed through an airlock (37) shown schematically in FIG. 1*a-e*. This means that the entire housing (2) does not have to be evacuated again before each casting process.

A production of the casting (36) comprises the following process steps, in particular in the order listed below:

Movement of the tungsten electrode (32) from an initial position shown in FIG. 1*a* to an end position shown in FIG. 1*b* above a pellet of cast material (15) to be melted, Evacuation of the housing (2) and introduction of a protective gas, preferably argon, Heating a getter (35), preferably made of titanium, to a temperature greater than 600° C., Formation of an electric arc (30) between the tip (31) of the tungsten electrode (32) and the pellet (15) to melt the pellet (15) and superheat it to a temperature between 75 and 1300° C. above its melting temperature, Switching off the electric arc and moving the tungsten electrode (32) back to the initial position shown in FIG. 1*a*, moving the casting plunger (20) and the sleeve (19) in the direction of the melting region (13) until the lower portion (23) of the sleeve (19) engages with the groove (18) so that a space (27), as shown in FIG. 1*c*, enclosing the melted pellet (15) is formed between the casting plunger (20) and the filling opening (16), A relative movement of the casting plunger (20) to the sleeve (19) against a spring force of the spring (22) to reduce the space (27), whereby the melted casting material (15) is pressed through the filling opening (16) into the mold cavity (17) of the casting mold (3) to form the casting (36). This movement is a movement of the casting plunger (20) from an initial filling position shown in FIG. 1*c* to a final position shown in FIG. 1*d* in which the mold cavity (17) is filled with the casting material (15), Movement of the casting plunger (20) and the sleeve (19) to an initial position above the melting region (13) as shown in FIG. 1*a*, Moving the two parts (4, 5) of the casting mold (3) apart into a casting removal position as shown in FIG. 1*e* and removing the casting (36) through the airlock (37) in the direction of the arrow (38), Closing the casting mold (3) and feeding a new pellet (15) from the pellet magazine (29) into the melting region (13).

An additional process step is conceivable, in which a suction device not shown in FIG. 1*a-e* which can be activated at the beginning of pressing in the casting material causes a negative pressure, through which the casting mold (3) is vented and the melted casting material (15) is additionally sucked into the casting mold (3).

It is also conceivable that the cast material (15) is melted by a laser beam and/or an electron beam.

Reference is now made to FIG. 2, where identical or equal-acting parts are designated with the same reference number as in FIG. 1*a-e* and the letter a is added to the respective reference number.

An apparatus (1*a*) shown in FIG. 2 differs from that shown in FIG. 1*a-e* in that two electrodes (32*a*, 38) are provided which are arranged to melt a pellet of cast material (15*a*) by forming two electric arcs (30*a*, 39). Advantageously, a faster heating, a higher superheating and processing of large cast material pellets (15*a*) is possible.

Reference is now made to FIG. 3, where identical or equal-acting parts are designated with the same reference number as in FIGS. 1*a-e* and 2 and the letter b is added to the respective reference number.

A casting mold (3*b*) of an apparatus (1*b*) according to the invention shown in FIG. 3 in top view differs from that shown in FIGS. 1 and 2 in that two melting regions (13*b*, 40) with a socket-like ridge are provided, on which two pellets (15*b*) are placed, covering two filling openings (16*b*, 41) shown in dashed lines. It goes without saying that at least one electric arc is required for melting in each melting region (13*b*, 40), as well as an casting plunger with sleeve which is not shown in FIG. 3. In particular, the two pellets (15*b*) are melted simultaneously and a melted casting material pellet (15*b*) is pressed into the casting mold (3*b*) by a preferably synchronized movement of the two casting plungers and sleeves.

Either a single mold cavity can be filled or several mold cavities can be filled simultaneously. Thus, the apparatus according to the invention can be used to produce either very large castings or several castings simultaneously with one single casting mold.

Reference is now made to FIG. 4, where identical or equal-acting parts are designated with the same reference number as in FIGS. 1*a-e*, 2 and 3 and the letter c is added to the respective reference number.

An apparatus (1*c*) shown in FIG. 4 differs from that shown in FIG. 1 in that a casting plunger (20*c*) and a sleeve (19*c*) are provided for pressing a casting material (15*c*) into a casting mold (3*c*) from a bottom side (42) thereof. A particularly laminar filling can be achieved advantageously. For reasons of clarity, neither a feeding device for the pellets nor a pyrometer is shown in FIG. 4.

A crucible-shaped melting region (13*c*) in which a pellet (15*c*) is located is formed by an end face (25*c*) of the pouring plunger (20*c*) and an inner wall (26*c*) of the sleeve (19*c*). The casting plunger (20*c*) and the pellet (15*c*) form a counter electrode to a tungsten electrode (32*c*), between which and the pellet (15*c*) an electric arc, not shown in FIG. 4, can be formed to melt the pellet (15*c*).

Reference is now made to FIG. 5, where identical or equal-acting parts are designated with the same reference number as in FIGS. 1*a-e*, 2, 3 and 4 and the letter d is added to the respective reference number.

An apparatus (1*d*) shown in FIG. 5 differs from the device (1*d*) shown in FIG. 1 to 4 in that a suction device (43) is provided which is fluidically connected to a casting mold channel (45) by a suction channel (44). The suction device (43) can be activated and, when an casting plunger (20*d*), through which a melted casting material (15*d*) is pressed into a casting mold (3*d*), moves, it additionally sucks a melted casting material into the casting mold (3*d*) from a side preferably facing away from the casting plunger (20*d*). This additional suction force is advantageous for better filling of the casting mold.

It goes without saying that the suction device (43) can also be located outside the housing (2*d*). It is further understood that a transition region from the suction channel (44) to the casting mold channel (43) is designed in such a way that an opening of a multi-part casting mold is still possible.

Reference is now made to FIG. 6, where identical or equal-acting parts are designated with the same reference number as in FIGS. 1*a-e*, 2, 3, 4 and 5 and the letter e is added to the respective reference number.

A two-part casting mold (3*e*) shown in FIG. 6 differs from the casting molds (3; 3*a*; 3*b*; 3*c*; 3*d*) shown in FIGS. 1 to 5 in that horizontal filling of a mold cavity (17*e*) is possible. A melting region (13*e*) comprises a recess (14*e*) in a portion (5*e*) of the casting mold (3*e*) in which a melted pellet of casting material (15*e*) shown in FIG. 6*a* is located.

A sleeve (19*e*) has an opening (46) in a lower sleeve portion (23*e*) through which melted casting material (15*e*) can be pressed into the mold cavity (17*e*) of the casting mold (3*e*).

An outside of the sleeve (19*e*) and an outside of the casting mold (3*e*), as well as an end surface of the sleeve (19*e*) and an upper surface of the casting mold (3*e*) also form a sealing surface.

It is conceivable that several electric arcs (30; 30*a*, 39) are formed between an electrode and a single, in particular pellet-shaped cast material (15; 15*a*; 15*b*; 15*c*; 15*d*; 15*e*).

It is further conceivable that a casting mold (3; 3*a*; 3*b*; 3*c*; 3*d*; 3*e*) is provided with several filling openings (16; 16*a*; 16*b*, 41; 16*c*; 16*d*; 16*e*) of different sizes. For this purpose, it is advantageous if a size of an casting plunger (20; 20*a*; 20*b*; 20*c*; 20*d*; 20*e*) is adapted to a size of the filling openings (16; 16*a*; 16*b*, 41; 16*c*; 16*d*; 16*e*) and/or a size of the casting pellets (15; 15*a*; 15*b*; 15*c*; 15*d*; 16*e*). In an apparatus (1; 1*a*; 1*b*; 1*c*; 1*d*; 1*e*) casting plungers (20; 20*a*; 20*b*; 20*c*; 20*d*; 20*e*) of different sizes can be provided for this purpose, which, for example, have different diameters.

The invention claimed is:

1. An apparatus for producing a casting formed from an amorphous or partially amorphous metal, which comprises:

a casting mold comprising a mold cavity and at least one filling opening for introducing a casting material forming the casting into the mold cavity;

a device for melting the casting material, the melting device comprising at least one melting region in which to melt the casting material, at least two electrodes being arranged at a distance from one another, and at least one electric arc formed between the at least two electrodes, whereas a first one of the at least two electrodes has a fixed proximal end and a movable distal end, the movable distal end has a first extendable horizontal configuration and a second retracted horizontal configuration in the same horizontal plane, and whereas a second one of the at least two electrodes is at least partially formed by the casting material; and a casting plunger: the casting material being forced into the mold cavity by at least the casting plunger when the casting plunger is actuated in a downwards direction;

whereas both the casting plunger and one of the at least two electrodes are arranged on the same side of the mold cavity in a single gas-tight housing, characterized in that the casting plunger, the casting mold and the at least two electrodes are arranged within the single gas-tight housing.

2. The apparatus according to claim 1, characterized in that the at least one melting region is integrally formed with the casting mold.

3. The apparatus according to claim 1, characterized in that the at least one melting region comprises a recess and/or a socket for receiving the casting material, wherein the recess and/or the socket is arranged at least partially around, and integrally formed with, the at least one filling opening.

4. The apparatus according to claim 1, characterized in that the at least one melting region is delimited by an end face of said casting plunger and an inner wall of a guiding means in which said casting plunger is mounted in a guided manner, the guiding means comprising a cylindrical sleeve.

5. The apparatus according to claim 1, characterized in that said casting plunger is movable relative to a guiding means in which said casting plunger is mounted in a guided manner against a direction of action of a restoring force of a restoring means.

6. The apparatus according to claim 1, characterized in that at least one said casting plunger, which is provided for pressing melted casting material into a mold cavity of the casting mold, is movable relative to a guiding means in which said casting plunger is mounted in a guided manner against a direction of action of a restoring force of a restoring means, wherein the at least one melting region has an annular groove and is provided for receiving the guiding means, the guiding means comprising a cylindrical sleeve that is configured to couple with the annular groove.

7. The apparatus according to claim 1, characterized in that a temperature of the casting mold is adjustable by a control device.

8. The apparatus according to claim 1, characterized in that the apparatus comprises a venting and/or sucking melted casting material into the casting mold with a suction device, the venting being activatable upon introduction of the casting material into the casting mold.

9. The apparatus according to claim 1, characterized in that the casting plunger and one of the at least two electrodes are arranged on the upper side of the mold cavity.

* * * * *